US010247177B2

(12) United States Patent
Ivantysynova et al.

(10) Patent No.: US 10,247,177 B2
(45) Date of Patent: Apr. 2, 2019

(54) POSITIVE DISPLACEMENT MACHINES AND METHODS OF INCREASING LOAD-CARRYING CAPACITIES THEREOF

(71) Applicant: Purdue Research Foundation, West Lafayette, IN (US)

(72) Inventors: Monika Marianne Ivantysynova, Lafayette, IN (US); Meike H. Ernst, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 258 days.

(21) Appl. No.: 15/207,889

(22) Filed: Jul. 12, 2016

(65) Prior Publication Data

US 2017/0016431 A1 Jan. 19, 2017

Related U.S. Application Data

(60) Provisional application No. 62/191,791, filed on Jul. 13, 2015.

(51) Int. Cl.

| | |
|---|---|
| ***F01B 31/10*** | (2006.01) |
| ***F04B 1/20*** | (2006.01) |
| ***F04B 53/18*** | (2006.01) |
| ***F01B 3/00*** | (2006.01) |
| ***F04B 39/02*** | (2006.01) |

(Continued)

(52) U.S. Cl.

CPC ..... *F04B 1/2035* (2013.01); *F01B 3/0044* (2013.01); *F03C 1/0652* (2013.01); *F04B 27/0834* (2013.01); *F04B 39/0292* (2013.01); *F04B 53/162* (2013.01); *F04B 53/18* (2013.01); *F04B 1/143* (2013.01)

(58) Field of Classification Search

CPC ..... F04B 27/0856; F04B 27/1045; F04B 27/109; F04B 39/0292; F04B 53/16; F04B 53/162

USPC ..... 92/57, 71, 158, 159

See application file for complete search history.

(56) References Cited

U.S. PATENT DOCUMENTS 3,153,987 A * 10/1964 Hans ..... F16J 1/22 92/158

3,169,488 A * 2/1965 Galliger ..... F01B 3/0052 92/57

(Continued)

*Primary Examiner* — Michael Leslie

(74) *Attorney, Agent, or Firm* — Hartman Global IP Law; Gary M. Hartman; Domenica N. S. Hartman

(57) ABSTRACT

Positive displacement machines and methods therefor capable of increasing a load-carrying capacity of a piston-cylinder lubrication interface of positive displacement machines having a cylinder block, a cylindrical bore defined in the cylinder block, a piston reciprocably disposed within the cylindrical bore, and a working fluid within the piston-cylinder lubrication interface to provide a load-bearing function between the piston and the bore wall of the cylinder bore. The method includes providing at least one circumferential groove on a bore wall of the cylindrical bore within the piston-cylinder lubrication interface having an opening facing the piston and that is in fluidic communication with the piston-cylinder lubrication interface so as to contain a portion of the working fluid, and operating the positive displacement machine such that the working fluid enters the cylindrical groove and promotes hydrostatic balancing of pressure of the working fluid within the piston-cylinder lubrication interface.

20 Claims, 15 Drawing Sheets

(51) Int. Cl.

| | |
|---|---|
| ***F04B 27/08*** | (2006.01) |
| ***F04B 53/16*** | (2006.01) |
| ***F03C 1/32*** | (2006.01) |
| *F04B 1/14* | (2006.01) |

(56) References Cited

U.S. PATENT DOCUMENTS

| | | | | |
|---|---|---|---|---|
| 4,799,419 | A * | 1/1989 | Krause | F03C 1/0652 92/57 |
| 6,324,959 | B1 * | 12/2001 | Akasaka | F04B 1/124 92/158 |
| 8,087,903 | B2 * | 1/2012 | Yokoyama | F04B 1/2035 92/57 |
| 8,104,398 | B2 * | 1/2012 | Bergmann | F04B 1/2078 92/158 |

* cited by examiner

POSITIVE DISPLACEMENT MACHINES AND METHODS OF INCREASING LOAD-CARRYING CAPACITIES THEREOF

CROSS REFERENCE TO RELATED APPLICATIONS

This application claims the benefit of U.S. Provisional Application No. 62/191,791, filed Jul. 13, 2015, the contents of which are incorporated herein by reference.

STATEMENT REGARDING FEDERALLY SPONSORED RESEARCH

This invention was made with government support under contract no. 2013-67021-21102 awarded by the U.S. Department of Agriculture. The government has certain rights in the invention.

BACKGROUND OF THE INVENTION

The present invention generally relates to fluid pumps and motors. The invention particularly relates to piston and cylinder assemblies suitable for use in positive displacement machines.

Axial piston machines are a type of positive displacement machine and generally comprise an array of cylindrical-shaped pistons that reciprocate within cylindrical bores within a cylinder block. In typical axial piston machines, the piston-cylinder combinations are parallel and arranged in a circular array within the cylinder block. An inlet/outlet port is defined at one end the cylinder block for each individual piston-cylinder combination, such that a working fluid can be drawn into and expelled from each cylinder bore through the port as the piston within the cylinder bore is reciprocated. The end of the cylinder block containing the inlet/outlet ports defines an axial sliding bearing surface that abuts a surface of a valve plate, while the opposite end of the cylinder block is connected to a drive shaft for rotation of the cylinder block. The valve plate defines an inlet opening and an outlet opening that are sequentially aligned with the inlet/outlet of each cylinder bore, so that the working fluid is drawn into each cylinder bore through the cylinder bore's inlet/outlet port when aligned with the valve plate inlet opening and expelled from each cylinder bore through the cylinder bore's inlet/outlet port when aligned with the valve plate outlet opening.

One end of each piston is in contact, either directly or through one or more intermediate components (for example, an attached slipper), with a swash plate inclined relative to the axis of the cylinder block. Generally, the swash plate may remain stationary while the cylinder block rotates, or the swash plate rotates while the cylinder block remains stationary, in order to produce axial motion in the pistons. The stroke length of each piston, and therefore displacement of the piston-cylinder combinations, can be made variable by changing the inclination (cam angle) of the swash plate. To provide this capability, the protruding end of each piston may be configured to have a ball-and-socket arrangement. The socket portion of this arrangement may be a slipper may have a planar surface that bears against the swash plate.

Between each piston and the wall of the cylinder bore in which it is received, there exists what will be referred to herein as a piston-cylinder lubrication interface. Within this interface, the bore and piston have opposing bearing surfaces with a diametrical clearance therebetween that defines a lubrication gap between the piston and bore wall. Within this lubrication gap, a continuous film of the working fluid is preferably always present to provide a bearing function that prevents direct contact between the piston and bore wall. Conventional axial piston machines lack sealing elements between their pistons and cylinder bore walls, and therefore the fluid film within the lubrication gap also serves as a hydrodynamic seal to minimize fluid leakage between the piston and the bore wall. Consequently, the sliding bearing surfaces of the piston and cylinder bore wall have both a load-bearing function and a sealing function, which differentiates piston-cylinder sliding bearings of axial piston machines from typical bearing applications that have only a load-bearing function.

Hydraulic fluids are ordinarily used to operate axial piston machines at high pressures, for example, operating pressures of about 300 to 420 bar. Pistons of swash plate type axial piston machines are often subjected to a significant dynamically changing side load during operation due to the combination of these high operating pressures and the variable cam angle of the swash plate. As a result of this off-axis eccentric loading, the lubrication gap between the piston and bore within the piston-cylinder lubrication interface varies along the length of the piston.

Though oil is generally used as the hydraulic working fluid in axial piston machines, the use of water in place of oil would provide several advantages. For example, water's low cost, environmentally friendly properties, thermal conductivity, bulk modulus, resistance to fire, and film strength make it a desirable working fluid relative to oil. However, because water has an extremely low viscosity, its use in axial piston machines is associated with high leakage rates and thus high power losses. More importantly, the low viscosity of water often makes it difficult to build up enough hydrodynamic pressure to perform the required bearing function in the piston-cylinder lubrication interface of swash plate type axial piston units. As noted above, very high side loads are often imposed on the pistons of these units, which increase significantly with increasingly higher operating pressures. As the side load rises, the piston-cylinder lubrication interface provided by water (and other low-viscosity working fluids) has an increased difficulty preventing metal-to-metal contact between the piston and cylinder bore wall, which can lead to catastrophic component failure. For this reason, axial piston machines currently are limited to a maximum operating pressure of approximately 200 bar when using water as the working fluid.

In view of the above, it can be appreciated that there are certain problems, shortcomings or disadvantages associated with the prior art, and that it would be desirable if axial piston machines were available that were capable of operating at pressures above 200 bar, and more preferably 300 bar, while using a low viscosity working fluid, such as water, and yet were capable of eliminating or at least significantly reducing metal-to-metal contact between their pistons and cylinder bore walls.

BRIEF DESCRIPTION OF THE INVENTION

The present invention provides positive displacement machines and methods therefor that are suitable for operating at pressures above 200 bar, and more preferably 300 bar, while using a low viscosity working fluid, such as water, yet are characterized by little or no metal-to-metal contact between the pistons and the cylinder bores.

According to one aspect of the invention, a positive displacement machine includes a cylinder block adapted to be rotated about an axis of the positive displacement machine, a plurality of cylindrical bores defined in the cylinder block and surrounding the axis, each of the cylindrical bores having a bore wall and a port, a plurality of pistons reciprocably disposed within the cylindrical bores wherein each of the pistons defines a piston-cylinder lubrication interface with the bore wall of a corresponding one of the cylindrical bores and defines a displacement chamber within the cylindrical bore adjacent the port thereof, a working fluid located within the displacement chambers and within the piston-cylinder lubrication interfaces to provide a load-bearing function between the pistons and the bore walls of the cylinder bores, and a plurality of circumferential grooves located within the piston-cylinder lubrication interfaces with at least one of the grooves being located on the bore wall of each of the cylindrical bores. The grooves have an opening facing the pistons and are in fluidic communication with the piston-cylinder lubrication interfaces so as to contain a portion of the working fluid. The grooves promote hydrostatic balancing of pressure of the working fluid within the piston-cylinder lubrication interfaces and increase a load-carrying capacity of the working fluid within the piston-cylinder lubrication interfaces during operation of the positive displacement machine.

According to another aspect of the invention, a method of improving a load-carrying capacity of a piston-cylinder lubrication interface of a positive displacement machine having a cylinder block, a cylindrical bore defined in the cylinder block and having a bore wall and a port, a piston reciprocably disposed within the cylindrical bore wherein the piston defines a piston-cylinder lubrication interface with the bore wall of the cylindrical bore and defines a displacement chamber within the cylindrical bore adjacent the port thereof, and a working fluid within the displacement chamber and within the piston-cylinder lubrication interface to provide a load-bearing function between the piston and the bore wall of the cylinder bore. The method includes providing at least one circumferential groove located on the bore wall of the cylindrical bore within the piston-cylinder lubrication interface wherein the groove has an opening facing the piston and is in fluidic communication with the piston-cylinder lubrication interface so as to contain a portion of the working fluid, and operating the positive displacement machine such that the working fluid enters the cylindrical groove and promotes hydrostatic balancing of pressure of the working fluid within the piston-cylinder lubrication interface.

Technical effects of the axial piston machine and method described above preferably include the capability of operating the axial piston machine at pressures of at least 200 bar, and more preferably 300 bar, while using a low viscosity working fluid, such as but not limited to water.

Other aspects and advantages of this invention will be better appreciated from the following detailed description.

DETAILED DESCRIPTION OF THE INVENTION

Figure 1:
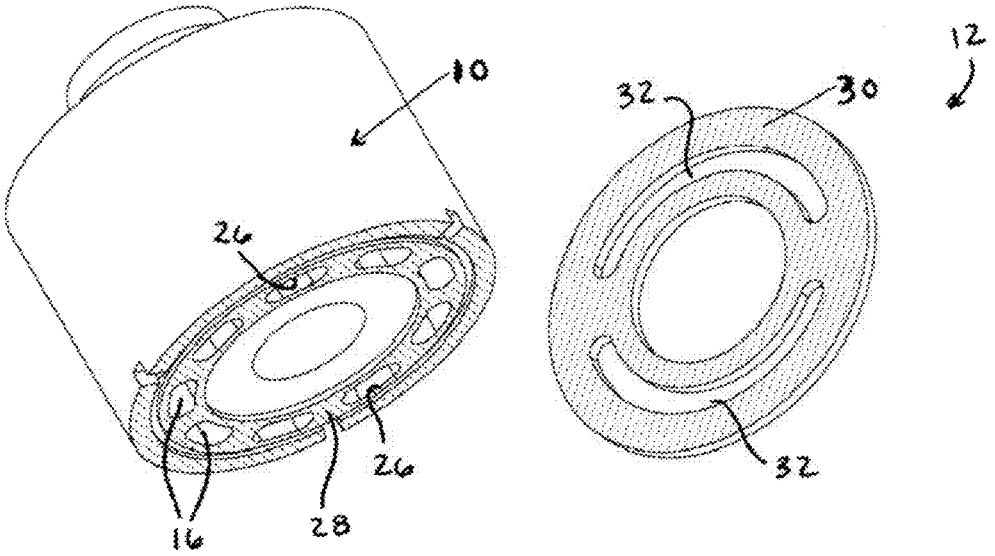
FIG. 1 shows perspective views of a cylinder block and a valve plate representative of components of an axial piston machine.
Figure 2:
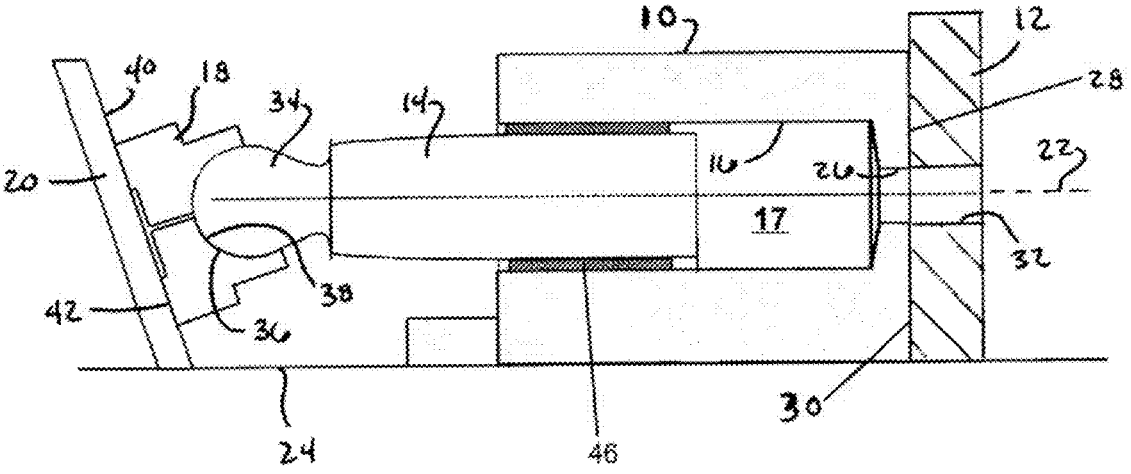
FIG. 2 is a cross-sectional view of one-half of an assembly comprising a cylinder block, a piston, a slipper, and a swash plate as representative components of an axial piston machine.

FIG. 1 is representative of a cylinder block 10 and valve plate 12 suitable for use in an axial piston machine. FIG. 2 represents a cross-sectional view of one-half of the cylinder block 10, and shows a piston 14 received within a cylinder bore 16 of the cylinder block 10, a slipper 18 coupled to one end of the piston 14, and a swash plate 20 abutting the slipper 18. The valve plate 12 may be conventionally located between the cylinder block 10 and an end case (not shown) of the axial piston machine. Consistent with conventional axial piston machines, the piston 14 and bore 16 define an axis 22 that is parallel to the axis 24 of the cylinder block 10. While the invention will be described in reference to an axial piston machine and the components represented in FIGS. 1 and 2, it should be understood that the invention is applicable to a variety of other machines capable of utilizing a hydrostatic sliding bearing surfaces, including other types of positive displacement pumps and motors such as bent axis piston machines and radial piston machines. All such applications are within the scope of this invention. It should be noted that the figures are drawn for purposes of clarity when viewed in combination with the following description, and therefore are not necessarily to scale.

The cylinder block 10 represented in FIG. 1 comprises a circular array of parallel cylinder bores 16, each of which receives a piston 14 in a manner similar to that represented in FIG. 2. The cylinder block 10 is formed to have an inlet/outlet port 26 for each of the cylinder bores 16, such that a working fluid can be drawn into and expelled from each cylinder bore 16 through the port 26 as the piston 14 within the bore 16 is reciprocated. The end of the cylinder block 10 containing the inlet/outlet ports 26 defines an axial sliding bearing surface 28 that abuts an axial sliding bearing surface 30 of the valve plate 12, represented in FIG. 2 as having an axis that coincides with the axis 24 of the cylinder block 10. Though not shown, it is well known in the art to configure the opposite end of the cylinder block 10 for connection to a drive shaft for rotation of the block 10 relative to the stationary valve plate 12. The valve plate 12 has a pair of inlet and outlet openings 32, which connect displacement chambers 17 within the bores 16 of the cylinder block 10 to ports of the axial piston machine.

As presented in FIG. 2, one end of each piston 14 protrudes from its bore 16 in the cylinder block 10 and engages the slipper 18. The slipper 18 engages the swash plate 20, which is stationary and inclined to the axis 24 of the cylinder block 10 to cause the pistons 14 to reciprocate within the cylinder block 10 as the block 10 is rotated relative to the swash plate 20. To provide a variable stroke/displacement capability, the assembly represented in FIG. 2 is configured to allow the inclination (cam angle) of the swash plate 20 to be altered relative to the cylinder block axis 24. In particular, the protruding end 34 of the piston 14 has a spherical surface 36 that engages a complementary spherical-shaped socket 38 formed in the slipper 18, providing a ball-and-socket coupling that allows the end 34 of the piston 14 to rotate and pivot within the socket 38 as the cylinder block 10 rotates. The slipper 18 has a planar surface 42 that bears against a planar surface 40 of the swash plate 20. The planar mating surfaces 40 and 42 of the swash plate 20 and each slipper 18 define axial sliding bearing surfaces. Each pair of bearing surfaces 40 and 42 is separated by a lubricating fluid film.

For purposes of discussing the present invention, other relevant structural and functional aspects of the axial piston machine and its axial sliding bearings represented in FIGS. 1 and 2 will be well understood by those skilled in the art, and therefore will not be discussed in further detail here.

Figure 3:
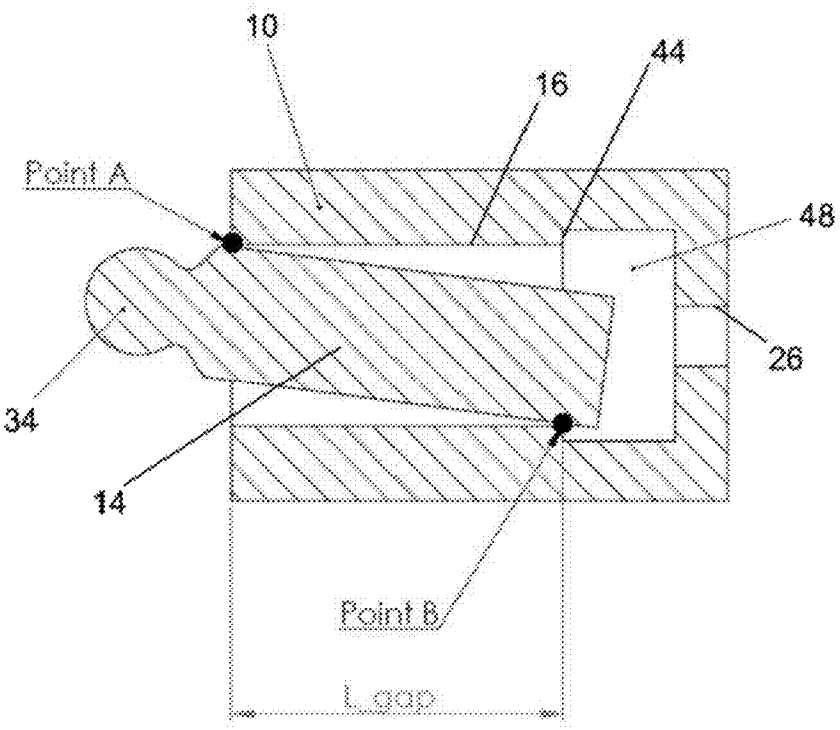
FIG. 3 schematically represents a cylinder and piston assembly of an axial piston machine that comprises a cylinder bore within a cylinder block and a piston therein that define a piston-cylinder lubrication interface characterized by a lubrication gap between the piston and bore that varies along the length of the piston.

FIG. 3 is a schematic representation of the cylinder and piston assembly of FIG. 2, and depicts a piston-cylinder lubrication interface (L_gap) defined by a limited portion (between Points "A" and "B") of the axial length of the cylinder bore 16 of the machine. Depending on the cam angle of the swash plate 20 and the difference between the pressure in the displacement chamber 48 and the ambient pressure external to the cylinder block of the machine, the piston 14 may be loaded with a high side force which is proportional to the pressure difference. This force, which is effectively an off-axis eccentric load, may result in a tilting of the piston 14 within the cylinder bore 16, exaggerated for purposes of illustration in the representation of FIG. 3. As a result, the lubrication gap varies between the piston 14 and bore 16 along the axial length of the piston-cylinder lubrication interface (between Points A and B). The fluid film in the piston-cylinder lubrication interface between the moving piston 14 and the cylinder bore 16 (or bushing 46) needs sufficient pressure to carry the high side force in order to prevent contact between the piston 14 and the cylinder bore 16 during operation, and to create a hydrodynamic seal capable of sealing the high pressure in the displacement chamber 48 against the low ambient pressure typically present externally of the cylinder block. Due to the inclined position of the piston 14 when loaded with high side force while moving in and out of the cylinder bore 16, contact may first occur at Points A and B. Contact between the piston 14 and the cylinder bore 16 can cause high friction and wear of the solid bodies and potentially lead to catastrophic machine failure of the axial piston machine.

Figure 4:
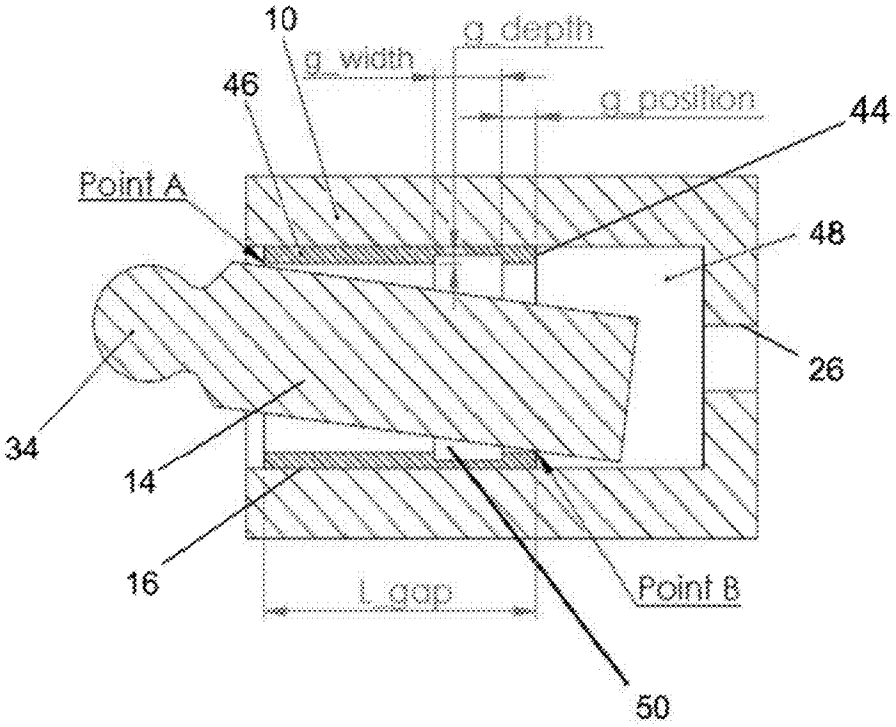
FIG. 4 schematically represents a cylinder and piston assembly of a first nonlimiting axial piston machine that includes a bushing located within its piston-cylinder lubrication interface and a single groove defined in an interior surface of the bushing.
Figure 5:
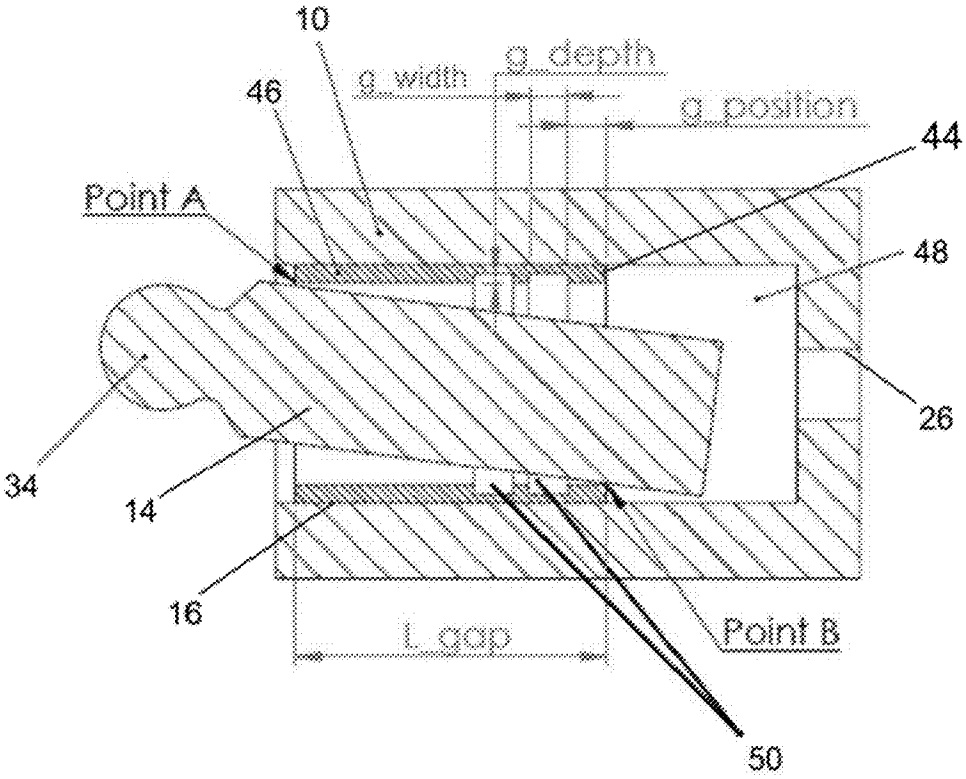
FIG. 5 schematically represents a cylinder and piston assembly of a second nonlimiting axial piston machine that includes a bushing located within its piston-cylinder lubrication interface and multiple grooves defined in an interior surface of the bushing.
Figure 6:
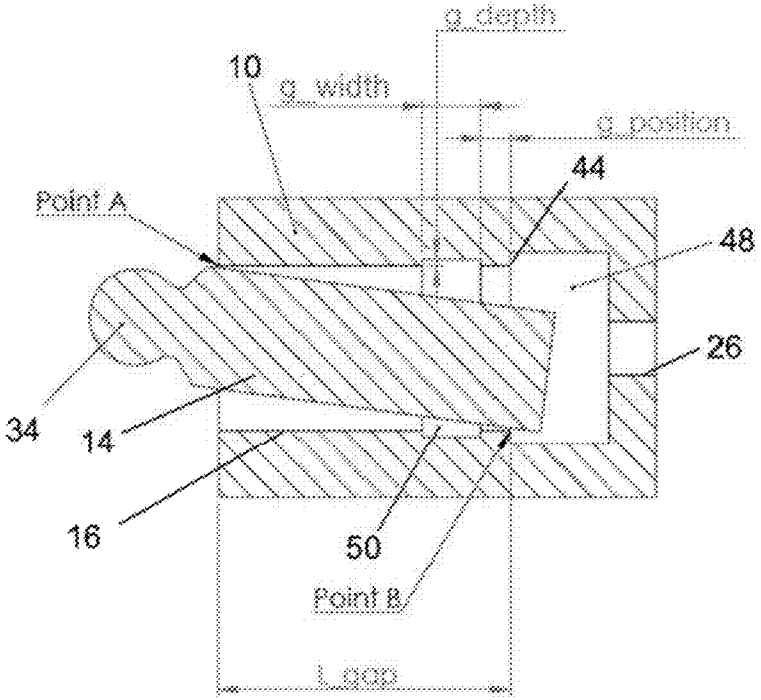
FIG. 6 schematically represents a cylinder and piston assembly of a third nonlimiting axial piston machine that has a groove directly defined in an interior surface of the cylinder block and located within its piston-cylinder lubrication interface.

FIGS. 4 through 6 schematically represent cylinder and piston assemblies similar to that represented in FIG. 3, but whose piston-cylinder lubrication interfaces (L_gap) have been modified to include one or more circumferential grooves 50 defined in the wall of the cylinder bore 16, which may be defined by the cylinder block 10 (FIG. 6) or defined by a bushing 46 installed in the cylinder block 10 (FIGS. 4 and 5). According to preferred aspects of the invention, the grooves 50 are intended to increase a load-carrying capacity of the working fluid film within each piston-cylinder lubrication interface by utilizing the pressure of working fluid within the grooves 50. The grooves 50, which in the course of operation build therein a certain hydrostatic pressure, increase the load-carrying capacity of the piston-cylinder lubrication interface and enable the design of axial piston machines that are capable of operating at high pressure while utilizing low viscosity fluids, for example, water. That is, the grooves 50 hydrostatically balance the pressure acting on the piston 14 within portions of the fluid film located near the displacement chamber 48. Aside from receiving working fluid that migrates from the displacement chambers 48 to the grooves 50 via the piston-cylinder lubrication interfaces, the circumferential grooves 50 preferably are not directly connected to any extraneous high pressure source of the working fluid, for example, via through-holes, channels, etc., in the cylinder block 10. The fluid film within each piston-cylinder lubrication interface and between the piston 14 and the surrounding wall of its cylinder bore 16 (defined by the cylinder block 10 or bushing 46) preferably has a film thickness on the order of a few microns during operation. In FIGS. 4 through 6, the piston-cylinder lubrication interface is defined by a portion of the cylinder bore 16 that has a smaller diameter than the displacement chamber 48 as a result of the piston-cylinder lubrication interface being either entirely defined by the bushing 46 (FIGS. 4 and 5) or defined by a reduced-diameter portion of the bore 16 (FIG. 6), such that in each case a circumferentially continuous radial step 44 is defined between the piston-cylinder lubrication interface and the displacement chamber 48. Also in FIGS. 4 through 6, the distance of the groove 50 from the displacement chamber 48 (or step 44) is denoted as "g_position," the depth of the groove 50 is denoted as "g_depth," and the width of the groove 50 in the axial direction of the bore 16 is denoted as "g_width."

FIG. 4 is a cross-sectional view that schematically represents a first nonlimiting axial piston machine comprising a piston 14 within a bushing 46 inside the cylinder bore 16. This figure shows one groove 50 located on the bushing 46 that defines the piston-cylinder lubrication interface and step 44 and guides the piston 14. FIG. 5 is a cross-sectional view that schematically represents a second nonlimiting axial piston machine similar to the machine of FIG. 4, but comprising two grooves 50 in the bushing 46 rather than one groove 50. FIG. 6 is a cross-sectional view that schematically represents a third nonlimiting axial piston machine in which the step 44 is defined by an undercut machined in the cylinder bore 16, such that the cylinder block 10 defines the piston-cylinder lubrication interface and step 44 and guides the piston 14. The groove 50 in the cylinder bore 16 of FIG. 6 is functionally similar to the groove 50 in the bushing 46 of FIG. 4.

In all of the embodiments of FIGS. 4 through 6, pressure from the displacement chamber 48 can enter the piston-cylinder lubrication interface where the piston 14 tilts away from the cylinder bore 16, resulting in a larger lubrication gap and a high pressure buildup within this region of the interface. The high pressure buildup exerts a downward force (relative to the orientation of FIGS. 4 through 6), pushing the piston 14 toward the circumferentially opposite side of the cylinder bore 16 (toward Point B). The grooves 50 promote hydrostatic balancing of the pressure at the "higher pressure" end of the piston-cylinder lubrication interface, i.e., adjacent the displacement chamber 48. This increases the load-carrying capacity of the fluid film between piston 14 and cylinder bore 16 due to additional hydrostatic bearing capacity, which reduces the likelihood of solid-to-solid contact near Point B.

Preferably, the end of the piston 14 represented as being within the displacement chamber 48 in FIGS. 4 through 6 never passes over the step 44 defined by the bushing 46 or undercut adjacent to the displacement chamber 48 as the piston 14 travels axially within the cylinder bore 16. In other words, in order for the grooves 50 to function as intended the end of the piston 14 within the displacement chamber 48 preferably always stays within the displacement chamber 48 and does not enter the piston-cylinder lubrication interface.

Thus, the axial piston machines disclosed herein include one or more circumferential grooves 50 in the wall of the cylinder bore 16 of a swash plate type axial piston machine to assist in supporting high piston side loads that can occur during operation. It is foreseeable and within the scope of the invention that the bushing 46 or cylinder bore 16 may include any number of grooves 50. Preferably, the grooves 50 have a depth (g_depth) of at least twenty micrometers, which is believed to be sufficient to maintain a uniform or constant pressure within the grooves 50. The width (g_width) of the single grooves 50 in FIGS. 4 and 6 and the sum of the widths of the multiple grooves 50 in FIG. 5 are each preferably at least ten percent of the axial length of the piston-cylinder lubrication interface (L_gap; guide length) in order to provide sufficient energy dissipation and load-carrying capacity. Regardless of the number of grooves 50, the position (g_position) of the groove 50 closest to the displacement chamber 48 is preferably at most fifty percent of the total axial length of the piston-cylinder lubrication interface (L_gap) (generally corresponding to the distance between Points A and B in FIGS. 4 through 6).

According to certain embodiments of this disclosure, methods are provided to increase the load-carrying capacity of the piston-cylinder lubrication interface of swash plate-type axial piston machines running with a low viscosity fluid, comprising providing at least one circumferential groove 50 in the cylinder bore 16 of the cylinder block 10 or in the bushing 46 installed in the cylinder block 10.

It should be noted that the concept of circumferential grooves 50 and their use as described herein are particularly beneficial to axial piston machines comprising low-viscosity working fluids such as, but not limited to, water. As used herein, low-viscosity working fluids include fluids with kinematic viscosity below 10 cSt (centistokes) measured at 40° C. However, it is foreseeable and within the scope of the invention that the circumferential grooves 50 may be used in axial piston machines that employ working fluids having viscosities above 10 cSt at 40° C. as well.

Nonlimiting embodiments of the invention will now be described in reference to investigations leading up to the invention. For the purpose of describing the results of computer simulations performed during these investigations, the piston-cylinder lubrication interface will be described hereinafter as having two separate regions split axially into two halves, including a lower-pressure end defined by the half of the lubrication interface closest to the piston end 34 and a higher-pressure end defined by the half of the lubrication interface closest to the displacement chamber 48.

Figure 7:
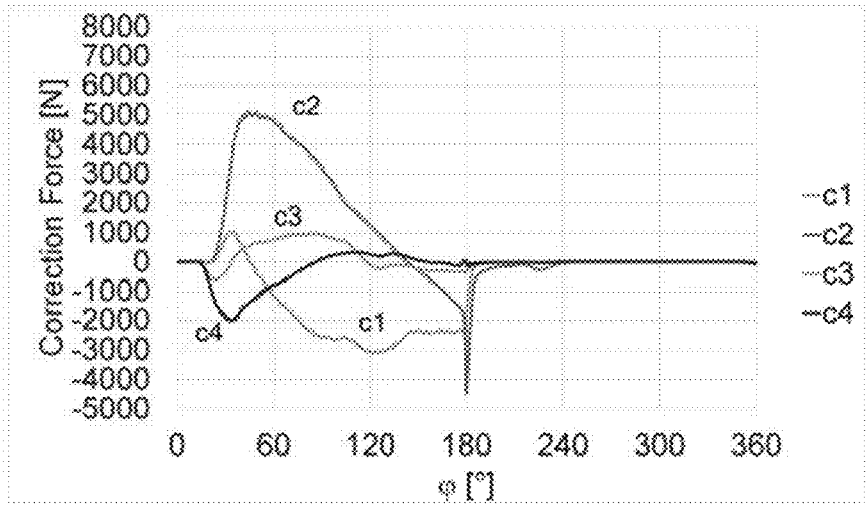
FIG. 7 includes two graphs representing the corrective forces of the piston-cylinder lubrication interface for an oil-based interface (top) and a water-based interface (bottom).
Figure 7:
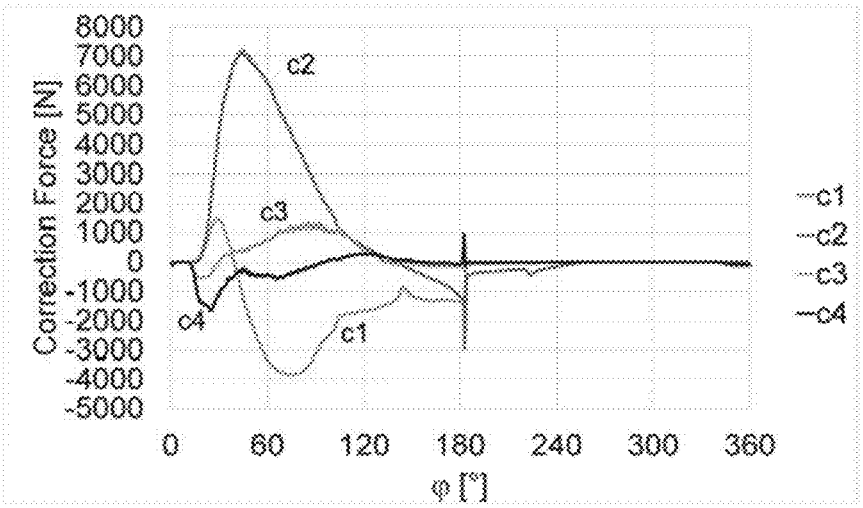

Initially, two baseline simulations were established, one representing a functional mineral oil-lubricated piston-cylinder lubrication interface (the OB baseline), the other a water-lubricated interface (the WB baseline). Correction forces at Points A and B for the OB baseline (top) and WB baseline (bottom) are represented in FIG. 7. These correction forces are forces that were calculated to be required in order to increase fluid pressure within regions of minimum film thickness (0.1 μm or less) in order to prevent metal-to-metal contact. Due to limitations with the modeling software, for low-viscosity fluid, it is likely that not all of these forces can be provided via fluid pressure, and that therefore some contact will result. The objective was therefore to keep these correction forces as low as possible in order to reduce the likelihood of metal-to-metal. The correction forces were imposed at two control points, one at each axial end of the piston-cylinder lubrication interface (Points A and B). The correction force at each control point was computed as the x- and y-components of a rotating coordinate system, with both components perpendicular to the axis of the cylinder bore 16.

The graphs in FIG. 7 plot the correction forces for the Gp18w18 simulation (top) and the Gp18w44 simulation (bottom). c1 and c2 are the x- and y-components, respectively, of the correction force imposed on at the control point on the higher-pressure end of the piston-cylinder lubrication interface (Point B), and c3 and c4 are the x- and y-components, respectively, of the correction force imposed on the control point on the lower-pressure end of the piston-cylinder lubrication interface (Point A).

Subsequent simulations were performed wherein the water-lubricated piston-cylinder lubrication interface of the water baseline was modified to include circumferential grooves as described herein. All simulations were based on a commercially available 75 cc swash plate-type axial piston machine. The operating conditions and relative clearance for each baseline are listed in Table 1, where relative clearance is defined as $(d_z-d_K)/d_K$ per mill, wherein $d_z$ is the diameter of the bushing 46 or cylinder bore 16 and $d_K$ is the diameter of the piston 14.

TABLE 1

| Input | Units | OB Baseline | WB Baseline |
|---|---|---|---|
| Pressure | bar | 300 | 300 |
| Speed | rpm | 3000 | 3000 |
| Displacement | % | 100 | 100 |
| Relative Clearance | | 1.6 per mill | 0.58 per mill |
| Inlet Temperature | ° C. | 52.5 | 35.2 |

The above-noted simulations included various investigations intended to explore variations in the width and position of the circumferential grooves 50 (groove_w and g_position, respectively). These particular investigations were performed at operating conditions specified in Table 2. In the WB simulation, the pistons were made of aluminum, the bushing were made of brass, and the cylinder block was made of stainless steel. These materials were used in all simulations except for the OB baseline which used the materials of an existing 75 cc swash plate-type axial piston machine. The groove_w and groove_p dimensions, along with their respective identification names are listed in Table 3. The simulations were named after the g_width and g_position dimensions, both of which are expressed as a percentage of the length of the bushing 46 for the 75 cc swash plate-type axial piston machine being simulated.

TABLE 2

| Input | Units | OB Baseline |
|---|---|---|
| Pressure | bar | 300 |
| Speed | rpm | 3000 |
| Displacement | % | 100 |
| Relative Clearance | | 0.58 per mill |
| Inlet Temperature | ° C. | 35.2 |

TABLE 3

| G_position (%) | G_width (%) | Simulation Name |
|---|---|---|
| 18 | 18 | Gp18w18 |
| 18 | 26 | Gp18w26 |
| 18 | 35 | Gp18w35 |
| 18 | 44 | Gp18w44 |
| 26 | 35 | Gp26w35 |
| 35 | 35 | Gp35w35 |

Figure 8:
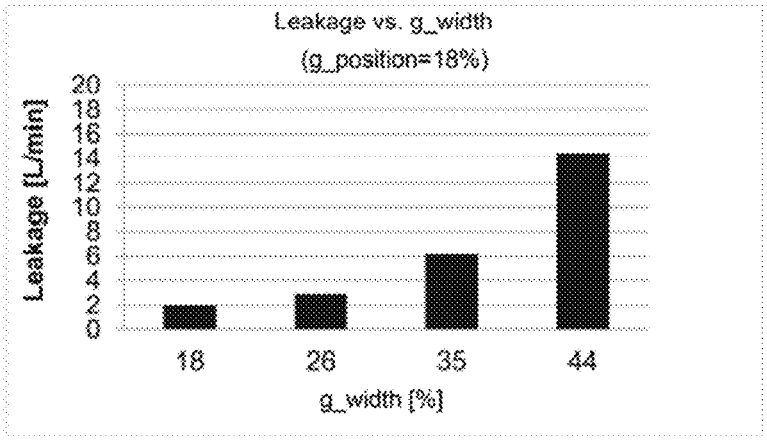
FIG. 8 includes three graphs representing leakage, torque loss, and energy dissipation due to viscous flow relative to various widths of a groove in the bushing of an axial piston machine of the type represented in FIG. 4.
Figure 8:
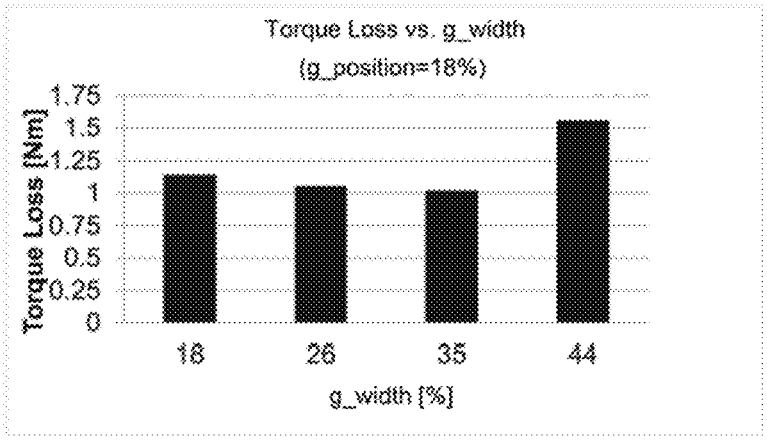
Figure 8:
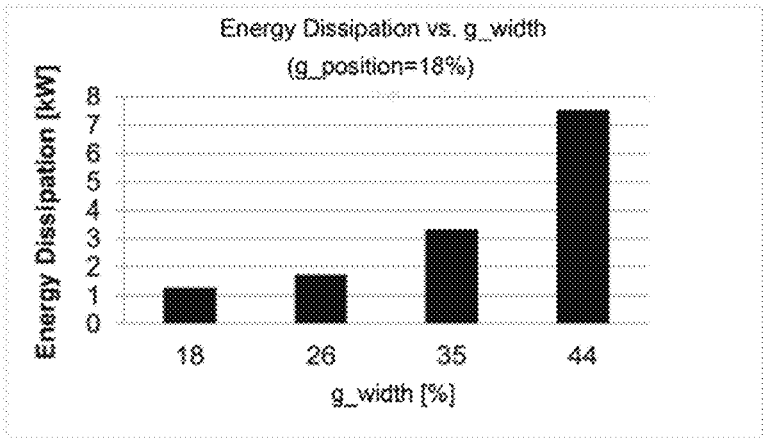

FIG. 8 plots the leakage, torque loss, and energy dissipation due to viscous flow relative to various widths of the groove 50 for all simulated piston-cylinder lubrication interfaces. As was to be expected, the leakage increased with an increase in the width of the groove 50; however, the increase was not linear. The torque loss did not appear to exhibit a clear pattern, but there was no significant jump in magnitude until the width of the groove 50 was raised to forty-four percent of the axial length of the bushing 46, and even then the torque loss remained relatively small. Due to the low torque loss values, the energy dissipation was guided almost entirely by the leakage losses as the width of the groove 50 increased. The energy dissipation of the Gp18w18 and Gp18w26 simulations were both lower than that of the OB baseline, while the energy dissipation of the Gp18w35 and Gp18w44 simulations were above the OB baseline benchmark.

Figure 9:
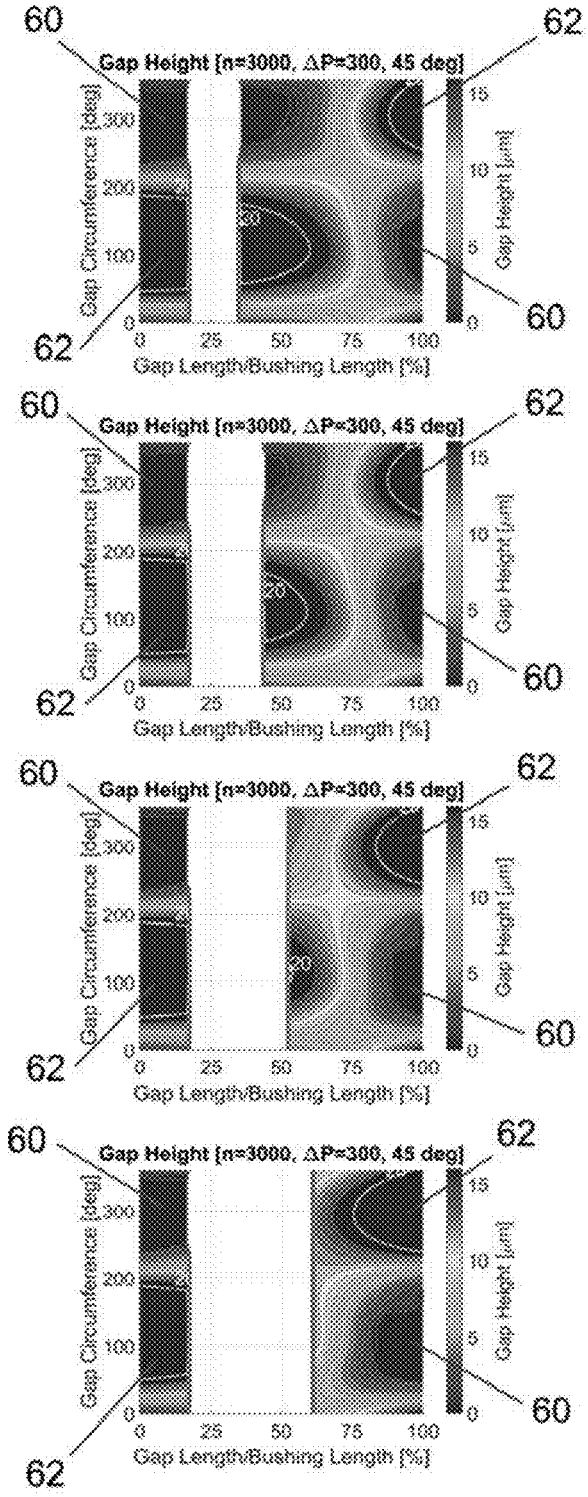
FIG. 9 includes four contour plots representing film thickness in the piston-cylinder lubrication interface at a drive shaft angle of forty-five degrees for various widths of a groove in the bushing of an axial piston machine of the type represented in FIG. 4.

FIG. 9 includes contour plots that represent the film thickness in the piston-cylinder lubrication interface for the Gp18w18, Gp18w26, Gp18w35, Gp18w44 simulations (respectively top to bottom), wherein φ is a drive shaft angle measured clockwise from outer dead center (that is, when the piston is furthest away from the valve plate 12). The vertical white stripes in the plots represent the region in the lubrication interfaces occupied by the groove 50, and the regions of minimum and maximum film thickness are identified by reference numbers 60 and 62, respectively. These plots indicate two trends. First, the region of minimum film thickness 60 on the higher-pressure end of the piston-cylinder lubrication interface (the upper left-hand corner of the contour plots) became progressively smaller as the width of the groove 50 in the bushing 46 increased. Second, the region of minimum film thickness 60 on the lower-pressure end of the piston-cylinder lubrication interface (lower right-hand corner of the contour plots) increased with an increase of the width of the groove 50.

Figure 10:
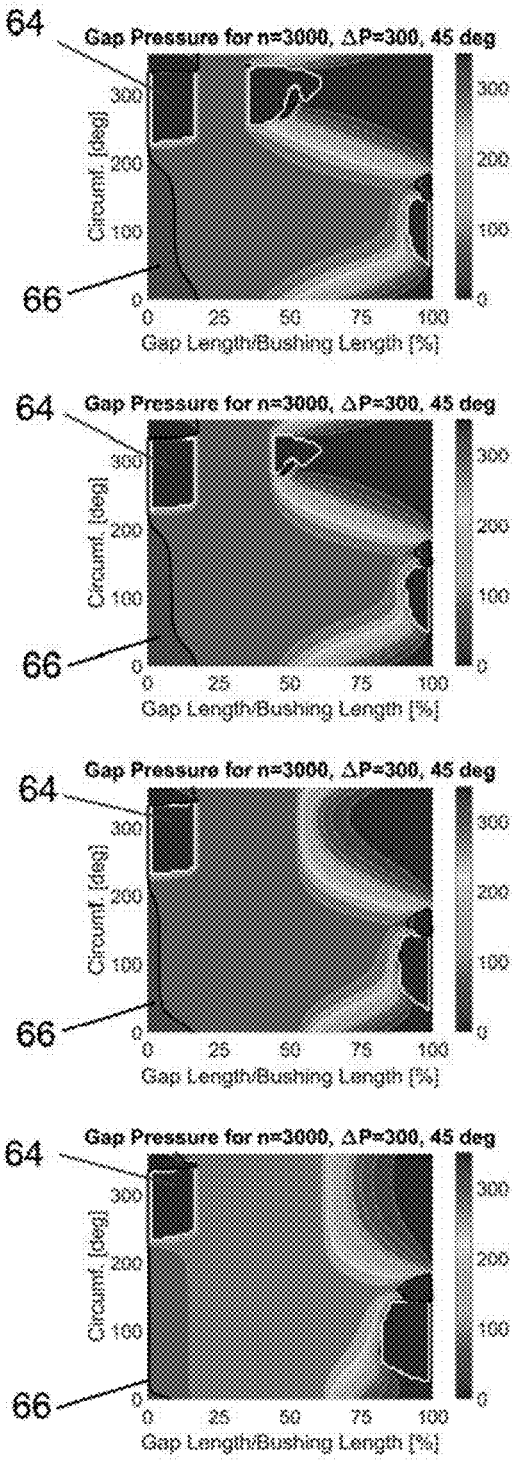
FIG. 10 includes four contour plots representing pressure in the piston-cylinder lubrication interface for various widths of a groove in the bushing of an axial piston machine of the type represented in FIG. 4.
Figure 11:
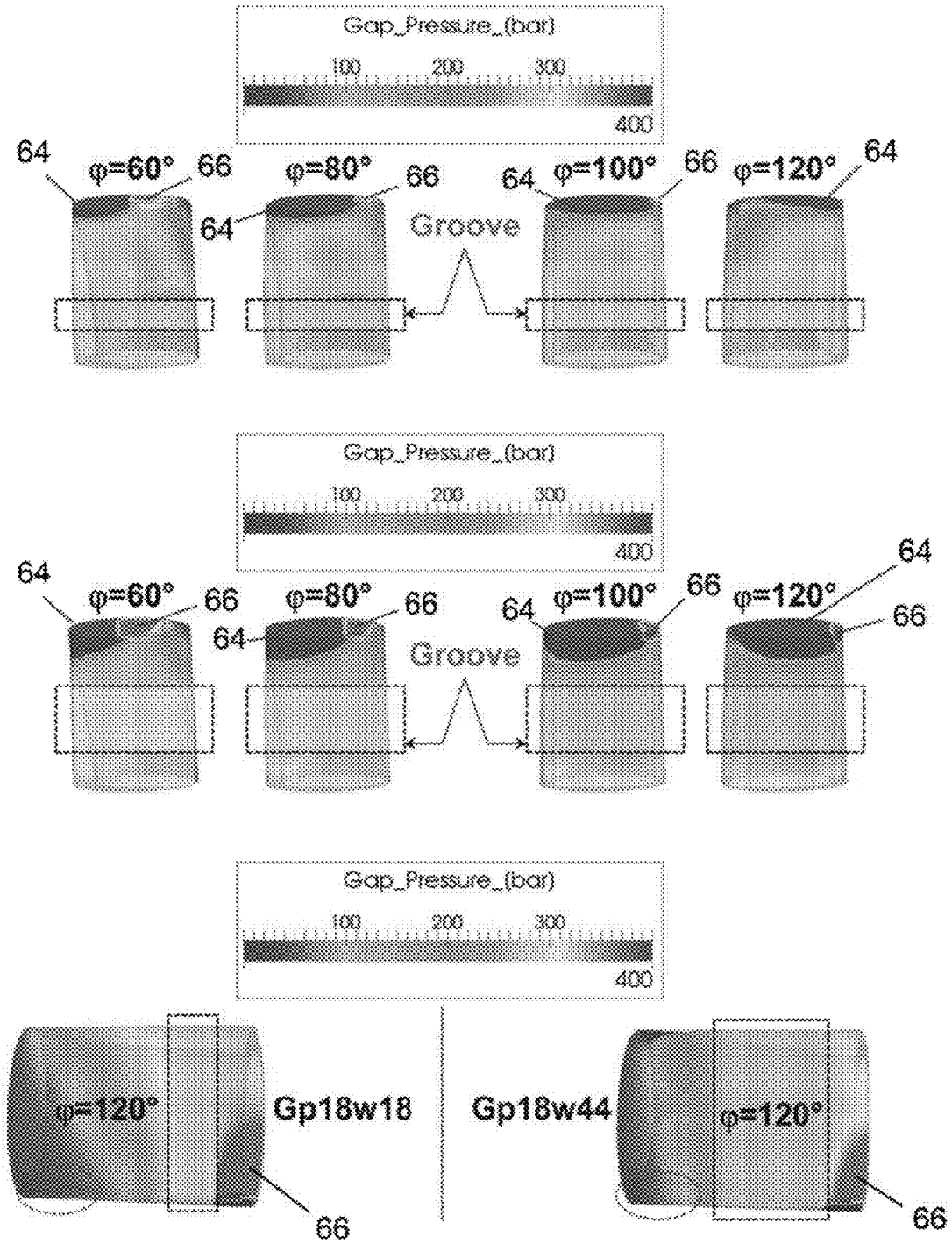
FIG. 11 includes top, middle, and bottom images representing pressure in the piston-cylinder lubrication interface of an axial piston machine of the type represented in FIG. 4. The top and middle images represent a Gp18w18 simulation and a Gp18w44 simulation at four different drive shaft angles: $\varphi=60°$, $\varphi=80°$, $\varphi=100°$, and $\varphi=120°$. The bottom image compares pressure for the Gp18w18 simulation (left) and the Gp18w44 simulation (right) at $\varphi=120°$.

The first trend may be explained by the pressure contour plots in FIG. 10, which correspond to the film thickness contour plots of FIG. 9 (minimum and maximum pressure are identified by reference numbers 64 and 66, respectively). As the width of the groove 50 increased, pressure that started as a dark region of 325 bar or more at the lower left edge of the pressure contour plot for the Gp18w18 simulation ended as a lighter colored region for the Gp18w44 simulation. The pressure buildup in this lower left region of the pressure contour plots pushed down on the piston 14, and therefore contributed to running the piston 14 into the bushing 46 on the higher-pressure end, as indicated by the dark region of nearly no pressure buildup in the upper left-hand corner of the pressure plots. As the pressure buildup along the lower left edge of the plots decreased in magnitude, the region of minimum film thickness in the upper left-hand corner of the contour plots in FIG. 9 shrank. FIG. 11 includes top, middle, and bottom images representing pressure in the piston-cylinder lubrication interface of an axial piston machine. The top and middle images represent a Gp18w18 simulation and a Gp18w44 simulation at four different drive shaft angles: φ=60°, φ=80°, φ=100°, and φ=120°. The bottom image compares pressure for the Gp18w18 simulation (left) and the Gp18w44 simulation (right) at φ=120°.

Figure 12:
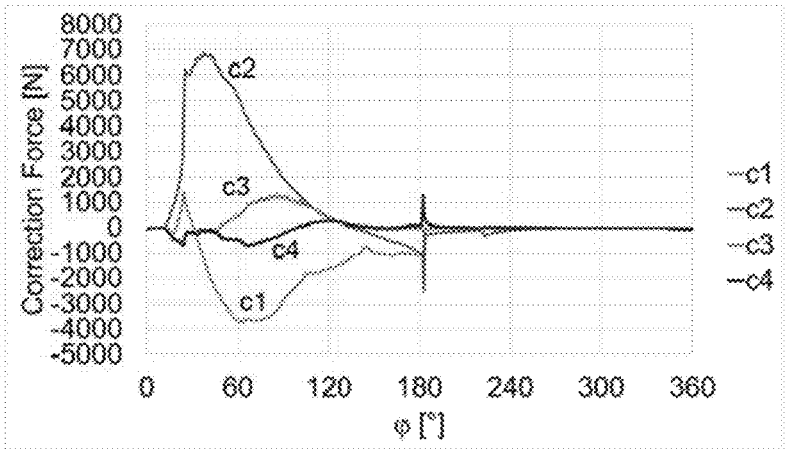
FIG. 12 includes two graphs representing the effect of groove width and location on the operation of an axial piston machine of the type represented in FIG. 4.
Figure 12:
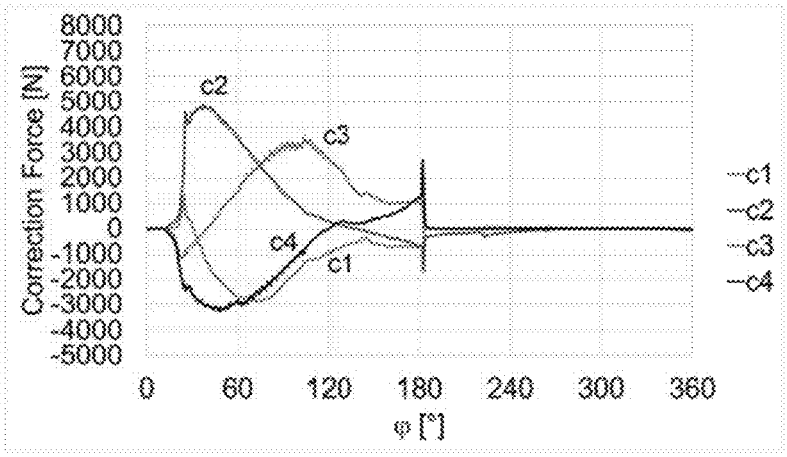

For these reasons, the maximum magnitude of the components of the correction forces over the high-pressure stroke (φ=0° to φ=180°) rose at the lower-pressure end as the width of the groove 50 became larger. However, because the groove 50 allowed for the pressure to equalize circumferentially on the higher-pressure end of the piston-cylinder lubrication interface, the maximum magnitude of the components of the correction forces over the high-pressure stroke at the higher-pressure end dropped as the width of the groove 50 increased. This can be seen in FIG. 12, which shows data representing the effect of groove width on the lower- and higher-pressure ends of the piston-cylinder lubrication interface. In going from the correction force plot of the Gp18w18 simulation to that of the Gp18w44 simulation, the maximum magnitude of the components of the correction forces at the higher-pressure end (Point B) of the piston-cylinder lubrication interface (lines c1 and c2) dropped dramatically over the high-pressure stroke.

Figure 13:
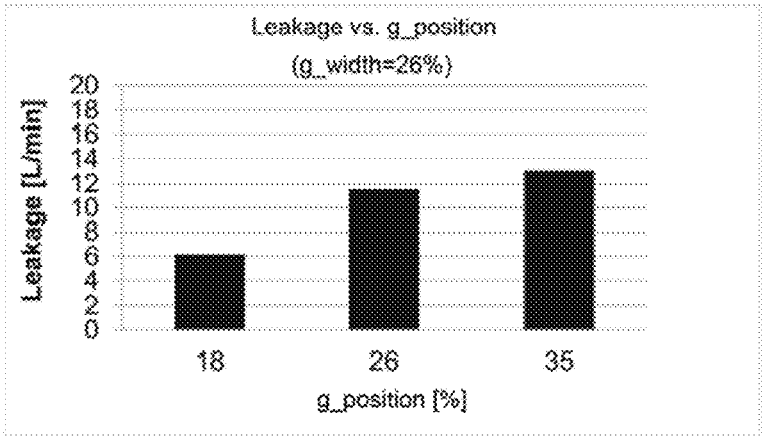
FIG. 13 includes three graphs representing leakage, torque loss, and energy dissipation due to viscous flow relative to various positions of a groove in the bushing of an axial piston machine of the type represented in FIG. 4.
Figure 13:
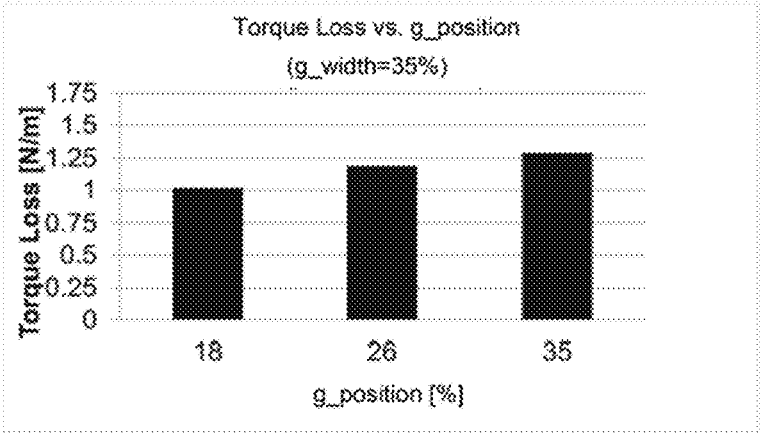
Figure 13:
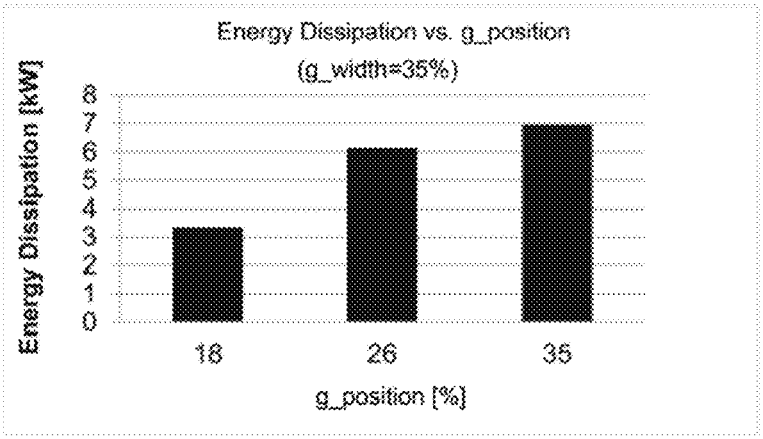
Figure 14:
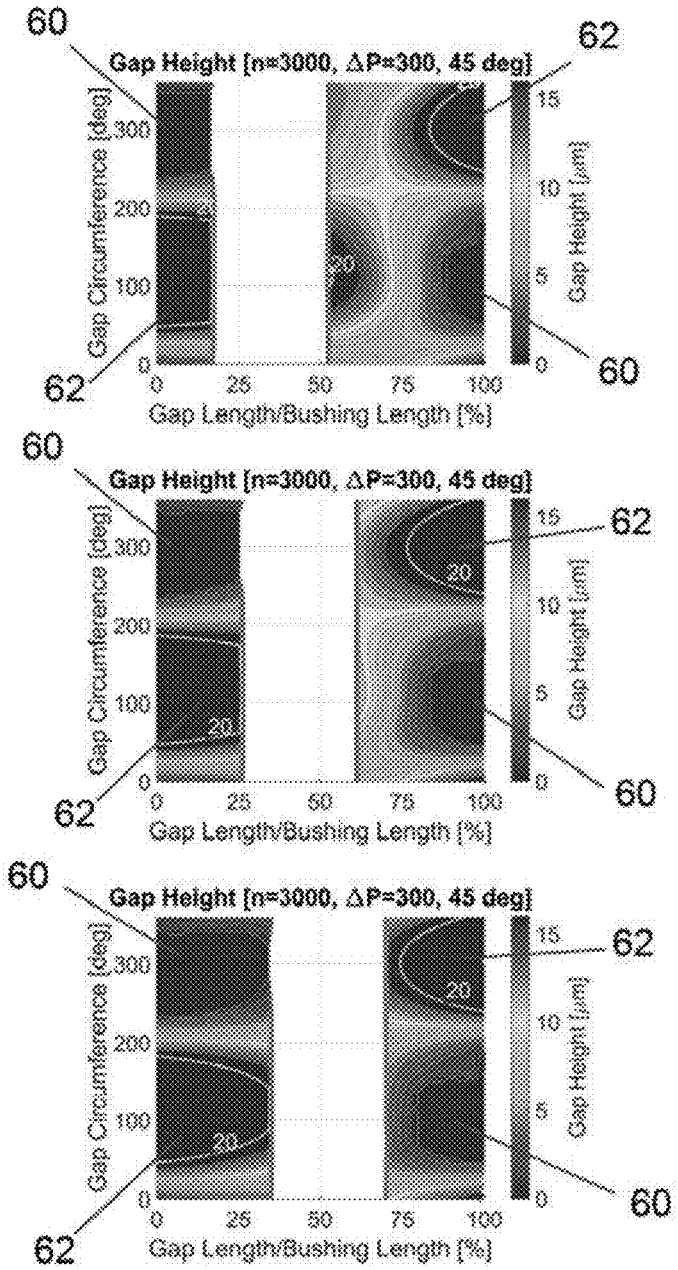
FIG. 14 includes three contour plots representing film thickness in the piston-cylinder lubrication interface at a drive shaft angle of forty-five degrees for various positions of a groove in the bushing of an axial piston machine of the type represented in FIG. 4.

The losses generated at the piston-cylinder lubrication interface relative to various positions (g_position), that is, distances of the groove 50 from the displacement chamber, are represented in FIG. 13. The leakage, torque loss, and energy dissipation all increased with an increase in the distance of the groove from the displacement chamber. FIG.

Figure 15:
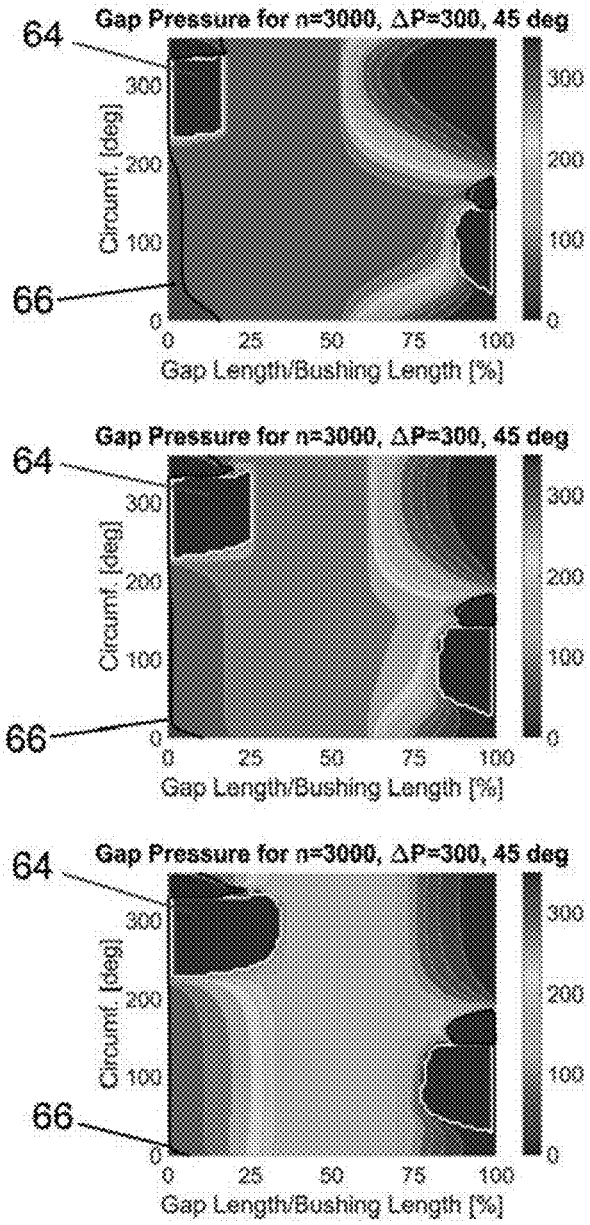
FIG. 15 includes three contour plots representing pressure in the piston-cylinder lubrication interface for various positions of a groove in the bushing of an axial piston machine of the type represented in FIG. 4.
Figure 16:
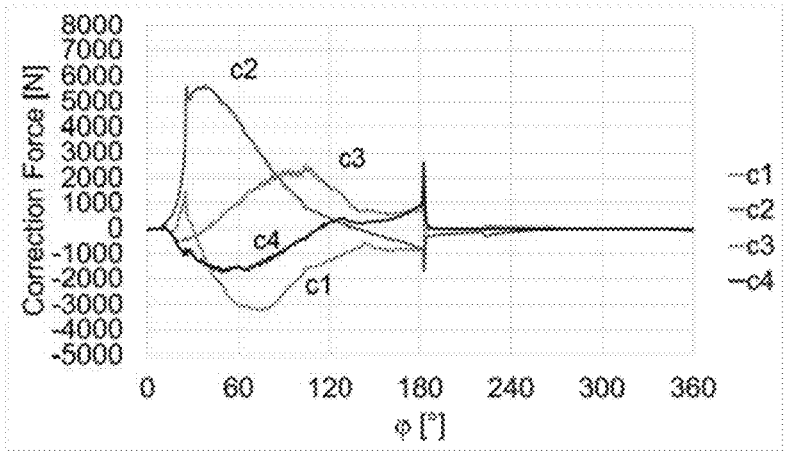
FIG. 16 includes two graphs representing the effect of groove position on the operation of an axial piston machine of the type represented in FIG. 4.
Figure 16:
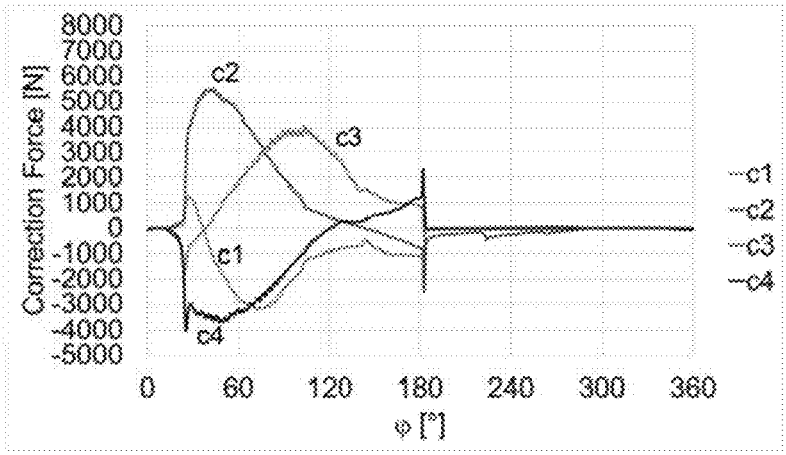

14 includes three contour plots representing film thickness in the piston-cylinder lubrication interface at a drive shaft angle of forty-five degrees for various positions of a groove in the bushing of an axial piston machine. FIG. 15 includes three contour plots representing pressure in the piston-cylinder lubrication interface for various positions of a groove in the bushing of an axial piston machine. FIG. 16 includes two graphs representing the effect of groove position on the lower- and higher-pressure ends of the piston-cylinder lubrication interface. As can be seen from the correction forces in FIG. 16, load support at the lower-pressure end of the piston-cylinder lubrication interface was negatively impacted as the groove was moved further from the displacement chamber. It is therefore preferable to keep the groove near the displacement chamber, in other words, in the half of the piston-cylinder lubrication interface nearest the displacement chamber.

Based on the above investigations, it was found that both increasing the width of the groove 50 and increasing the distance of the groove 50 from the displacement chamber increased energy dissipation. However, it was also determined that a wide groove 50, such as that found in the Gp18w44 simulation, can significantly improve load support at the higher-pressure end of the piston-cylinder lubrication interface.

While the invention has been described in terms of specific embodiments, it is apparent that other forms could be adopted by one skilled in the art. For example, the physical configuration of the axial piston machine and its components could differ from that shown, and materials and processes/methods other than those noted could be used. Therefore, the scope of the invention is to be limited only by the following claims.

The invention claimed is:

1. A positive displacement machine comprising:

a cylinder block adapted to be rotated about an axis of the positive displacement machine;

a plurality of cylindrical bores defined in the cylinder block and surrounding the axis, each of the cylindrical bores having a bore wall and a port;

a plurality of pistons reciprocably disposed within the cylindrical bores, each of the pistons defining a piston-cylinder lubrication interface with the bore wall of a corresponding one of the cylindrical bores and defining a displacement chamber within the cylindrical bore adjacent the port thereof;

a working fluid located within the displacement chambers and within the piston-cylinder lubrication interfaces to provide a load-bearing function between the pistons and the bore walls of the cylinder bores;

a circumferencially continuous radial step in a surface of each of the cylindrical bores between the piston-cylinder lubrication interface and the displacement chamber thereof that defines an end of the piston-cylinder lubrication interface, wherein distal ends of the pistons are located within the displacement chambers of the cylinder bores, do not pass the radial steps of the cylindrical bores, and do not enter the piston-cylinder lubrication interfaces as the pistons reciprocate within the cylindrical bores during operation of the positive displacement machine; and a plurality of circumferential grooves located within the piston-cylinder lubrication interfaces, at least one of the grooves being located on the bore wall of each of the cylindrical bores, the grooves having an opening facing the pistons and in fluidic communication with the piston-cylinder lubrication interfaces so as to contain a portion of the working fluid, wherein the grooves promote hydrostatic balancing of pressure of the working fluid within the piston-cylinder lubrication interfaces and increase a load-carrying capacity of the working fluid within the piston-cylinder lubrication interfaces during operation of the positive displacement machine.

2. The positive displacement machine of claim 1, wherein the cylinder block defines the bore wall of each of the cylindrical bores and the grooves are formed in surfaces of the cylinder block.

3. The positive displacement machine of claim 2, wherein the radial step of each of the cylindrical bores is defined by an undercut in the surface of the cylindrical bore.

4. The positive displacement machine of claim 1, further comprising bushings located within the cylindrical bores and surrounding the pistons, wherein the bushings define the bore walls of the cylindrical bores and the grooves are formed in surfaces of the bushings.

5. The positive displacement machine of claim 4, wherein ends of the bushings adjacent the displacement chambers define the radial steps of the cylindrical bores.

6. The positive displacement machine of claim 1, wherein a distance between edges of the grooves closest to the displacement chambers of the cylindrical bores and ends of the piston-cylinder lubrication interface adjacent the displacement chambers is not more than fifty percent of a total axial length of the piston-cylinder lubrication interface.

7. The positive displacement machine of claim 1, wherein the grooves have axial widths or a sum of axial widths along longitudinal axes of the cylindrical bores that each are at least ten percent of a total axial length of the piston-cylinder lubrication interface.

8. The positive displacement machine of claim 1, wherein the grooves have depths in directions perpendicular to longitudinal axes of the cylindrical bores of at least twenty micrometers.

9. The positive displacement machine of claim 1, wherein the grooves are not directly connected to any high pressure source of the working fluid other than through the piston-cylinder lubrication interfaces.

10. The positive displacement machine of claim 1, wherein the working fluid is a low viscosity fluid.

11. A method of improving a load-carrying capacity of a piston-cylinder lubrication interface of a positive displacement machine comprising a cylinder block, a cylindrical bore defined in the cylinder block and having a bore wall and a port, a piston reciprocably disposed within the cylindrical bore, the piston defining a piston-cylinder lubrication interface with the bore wall of the cylindrical bore and defining a displacement chamber within the cylindrical bore adjacent the port thereof, and a working fluid within the displacement chamber and within the piston-cylinder lubrication interface to provide a load-bearing function between the piston and the bore wall of the cylinder bore, the method comprising:

providing a circumferencially continuous radial step in a surface of the cylindrical bore between the piston-cylinder lubrication interface and the displacement chamber thereof that defines an end of the piston-cylinder lubrication interface; and providing at least one circumferential groove located on the bore wall of the cylindrical bore within the piston-cylinder lubrication interface, the groove having an opening facing the piston and in fluidic communication with the piston-cylinder lubrication interface so as to contain a portion of the working fluid; and operating the positive displacement machine such that a distal end of the piston located within the displacement chamber of the cylinder bore does not pass the radial step of the cylindrical bore and does not enter the piston-cylinder lubrication interface as the piston reciprocates within the cylindrical bore, and the working fluid enters the cylindrical groove and promotes hydrostatic balancing of pressure of the working fluid within the piston-cylinder lubrication interface.

12. The method of claim 11, wherein the cylinder block defines the bore wall of the cylindrical bore and the groove is formed in surfaces of the cylindrical block.

13. The method of claim 12, wherein the radial step of the cylindrical bore is defined by an undercut in the surface of the cylindrical bore.

14. The method of claim 11, wherein the positive displacement machine includes a bushing located within the cylindrical bore and surrounding the piston, the bushing defining the bore wall of the cylindrical bore, the method comprising forming the groove in surfaces of the bushing.

15. The method of claim 14, wherein an end of the bushing adjacent the displacement chamber defines the radial step of the cylindrical bore.

16. The method of claim 11, further comprising providing a distance between an edge of the groove closest to the displacement chamber of the cylindrical bore and an end of the piston-cylinder lubrication interface adjacent the displacement chamber is not more than fifty percent of a total axial length of the piston-cylinder lubrication interface.

17. The method of claim 11, further comprising providing the groove to have an axial width along a longitudinal axis of the cylindrical bore that is at least ten percent of a total axial length of the piston-cylinder lubrication interface, or providing the groove to have an axial width along a longitudinal axis of the cylindrical bore that in combination with the axial widths of other circumferential grooves located on the bore wall to have a combined axial width of at least ten percent of a total axial length of the piston-cylinder lubrication interface.

18. The method of claim 11, further comprising providing the groove to have a depth in a direction perpendicular to a longitudinal axis of the cylindrical bore of at least twenty micrometers.

19. The method of claim 11, wherein the groove is not directly connected to any high pressure source of the working fluid other than through the piston-cylinder lubrication interfaces.

20. The method of claim 11, wherein the working fluid is a low viscosity fluid.

* * * * *